US010332665B2

(12) United States Patent
Guenter et al.

(10) Patent No.: US 10,332,665 B2
(45) Date of Patent: Jun. 25, 2019

(54) LAYOUT FOR MAGNET COILS WOUND WITH ANISOTROPIC SUPERCONDUCTOR, AND METHOD FOR LAYING OUT THE SAME

(71) Applicant: Bruker BioSpin AG, Faellanden (CH)

(72) Inventors: Kenneth Guenter, Zurich (CH); Patrik Vonlanthen, Schwerzenbach (CH); Robert Schauwecker, Zurich (CH)

(73) Assignee: BRUKER BIOSPIN AG, Faellanden (CH)

( * ) Notice: Subject to any disclaimer, the term of this patent is extended or adjusted under 35 U.S.C. 154(b) by 329 days.

(21) Appl. No.: 15/368,325

(22) Filed: Dec. 2, 2016

(65) Prior Publication Data

US 2017/0162310 A1 Jun. 8, 2017

(30) Foreign Application Priority Data

Dec. 2, 2015 (DE) ..... 10 2015 223 991

(51) Int. Cl.
*H01F 6/06* (2006.01)
*H01F 41/04* (2006.01)

(52) U.S. Cl.
CPC ..... *H01F 6/06* (2013.01); *H01F 41/048* (2013.01)

(58) Field of Classification Search
CPC ..... H01F 6/06; H01F 41/048
See application file for complete search history.

(56) References Cited

U.S. PATENT DOCUMENTS

| | | | | |
|---|---|---|---|---|
| 5,319,333 | A | 6/1994 | Roth et al. | |
| 5,525,583 | A | 6/1996 | Aized et al. | |
| 5,581,220 | A | 12/1996 | Rodenbush et al. | |
| 5,659,277 | A | 8/1997 | Joshi et al. | |
| 7,317,369 | B2 | 1/2008 | Roth et al. | |
| 2006/0055494 | A1 | 3/2006 | Niemann et al. | |
| 2007/0008055 | A1 | 1/2007 | Roth et al. | |
| 2013/0130914 | A1* | 5/2013 | Boffo | G21K 1/093 505/211 |
| 2015/0213930 | A1 | 7/2015 | Seung-Yong et al. | |
| 2016/0351310 | A1* | 12/2016 | Rey | H01F 6/06 |

FOREIGN PATENT DOCUMENTS

| | | | |
|---|---|---|---|
| DE | 3923456 | A1 | 1/1991 |
| DE | 102004043987 | B3 | 5/2006 |
| DE | 102004043988 | B3 | 5/2006 |

(Continued)

OTHER PUBLICATIONS

Daeumling, M. et al., "Factors determining the magnetic field generated by a solenoid made with a superconductor having current anisotropy", 1995, Cryogenics, vol. 35, pp. 867-870.

(Continued)

*Primary Examiner* — Paul A Wartalowicz
(74) *Attorney, Agent, or Firm* — Edell, Shapiro & Finnan, LLC

(57) ABSTRACT

A layer wound magnet coil includes a central coil region and end coil regions adjoining the central coil region along an axial line of symmetry. The central coil region includes layers of coil windings of an anisotropic material. The end coil regions include layers of coil windings of the anisotropic superconducting material interspersed with layers of non-superconducting material.

14 Claims, 6 Drawing Sheets

(56) References Cited

FOREIGN PATENT DOCUMENTS

| | | |
|---|---|---|
| JP | S6165411 A | 4/1986 |
| JP | H065414 A | 1/1994 |

OTHER PUBLICATIONS

Weijers H.W. et al., "Effects of conductor anisotropy on the design of BiSCO sections of 25 T solenoids", 2003, Supercond. Sci. Technol. vol. 16, pp. 672-681.

Kang J. et al., "Radial magnetic field reduction to improve critical current of HTS solenoid", Physica. C., 2002, vol. 372-76 (3), pp. 1368-1372.

Chen, X.Y. et al., "Evaluation of Step-Shaped Solenoidal Coils for Current-Enhanced SMES Applications", IEEE Transactions an Applied Superconductivity, vol. 24, 2014, No. 5, S. 1-4, IEEE Xplore [online], D01: 101109/TASC.2014.2356572.

Noguchi, So et al., "An Optimal Design Method for Superconducting Magnets Using HTS Tape", IEEE Transactions on Applied Superconductivity, vol. 11, No. 1, Mar. 2001, pp. 2308-2311.

Noguchi, So et al., "An Optimal Design Method for SMES Coils Using HTS Tapes", IEEE Transactions on Applied Superconductivity, vol. 12, No. 1, Mar. 2002, pp. 1459-1462.

* cited by examiner

LAYOUT FOR MAGNET COILS WOUND WITH ANISOTROPIC SUPERCONDUCTOR, AND METHOD FOR LAYING OUT THE SAME

CROSS REFERENCE TO RELATED APPLICATIONS

This application claims foreign priority under 35 U.S.C. § 119(a)-(d) to German Application No. 10 2015 223 991.8 filed on Dec. 2, 2015, the entire contents of which are hereby incorporated by reference.

FIELD OF THE INVENTION

Superconducting magnet coils make it possible to generate strong and temporally constant magnetic fields in an extremely energy-efficient manner, since they can be operated entirely without, or at least with very minimal, Ohmic losses.

BACKGROUND

The electrical current-carrying capacity of a superconductor is determined by its critical current $I_c$. If the electrical current in the conductor exceeds the value of $I_c$, a phase transition converts the superconductor back to a normal state in which the current no longer flows without resistance.

In an isotropic superconductor, the current-carrying capacity depends on the strength of the magnetic field to which it is exposed, but not on the direction of the magnetic field. In contrast, in an anisotropic superconductor, the current-carrying capacity is also influenced by the angle of the magnetic field relative to the superconductor. This is true of high-temperature superconductors (HTSs), for example, (RE)BCO or Bi-2223, the underlying copper oxide structure of which has an anisotropic, two-dimensional character. The critical current of an HTS strip conductor in a magnetic field perpendicular to the strip plane is therefore typically lower than in a magnetic field parallel to the strip plane.

In a cylindrically symmetrical magnet coil of wound HTS strip conductors, this normally results in the current-carrying capacity of the coil being limited at the axial ends because the radial component of the magnetic field is greatest at the axial ends.

In some example of prior art coils (e.g., U.S. Pat. No. 5,525,583 and U.S. Pre-Grant Publication No. 2015/0213930), the current-carrying capacity of the coil at the axial ends is increased by using a superconductor for the corresponding windings which has a higher current-carrying capacity (e.g., a larger conductor cross-section, or a type of superconductor which has a higher critical current density). One disadvantage of this solution is that it is not possible to use a single type of superconductor in the coil, and the different conductor pieces must necessarily be connected in series with low resistance to operate. In addition, many prior art coils do not consider layer wound coils. They only consider coils which consist of multiple sections or pancakes positioned axially along the axis.

A further known option (e.g., U.S. Pat. No. 5,659,277) for increasing current-carrying capacity relies on ferromagnetic flanges on the ends of the coil to guide the magnetic flux around the superconductor, locally reducing the maximum radial component of the magnetic field. However, the relatively weak magnetization of ferromagnets significantly limits the efficiency of this method.

Another prior art coil (e.g., U.S. Pat. No. 5,581,220) discloses an arrangement in which the number of windings is reduced on the axial coil ends. However, this known coil is an arrangement of multiple double-pancake coils, and not a layer wound solenoid coil as described herein. In addition, this arrangement is not intended to reduce the radial field components at the ends of the coil.

Additional prior art solutions (e.g., "Factors determining the magnetic field generated by a solenoid made with a superconductor having current anisotropy", M. Däumling and R. Flükiger, (1995) Cryogenics, Vol. 35. pp. 867-870; "Effects of conductor anisotropy on the design of BiSCCO sections of 25 T solenoids", H. W. Weijers et al. (2003), Supercond. Sci. Technol. Vol. 16, pp. 672-681; and "Radial magnetic field reduction to improve critical current of HTS solenoid", J. Kang et al, Physica. C., 2002, vol. 372-76 (3), pp. 1368-1372) recognize that it is possible to increase the operating field in a working volume by reducing the radial field at the edge of an HTS coil, of these prior art solutions suggest coils of different lengths to reduce the radial field. However, the operating field increase in the working volume which results from this measure is small. Moreover, an additional winding body is necessarily required in each of the known arrangements.

Another prior art coil (e.g., German Publication No. DE 102004043987 B3 discloses a superconductive magnet coil arrangement having at least one section made of a superconductive strip conductor which is continuously wound in a cylindrical winding chamber between two end flanges in multiple, solenoid-like layers. This prior art coil is characterized in that the section has an axial region of reduced current density or a notch region.

Yet other prior art coils (e.g., German Publication No. DE 39 23 456 C2) describe a superconducting, homogenous, high field magnet coil in which the current density in the axial end region is reduced in such a manner that the forces acting on the windings can be kept low.

Still other prior art coils (e.g., German Publication No. DE 10 2004 043 988 B3) disclose a superconductive magnet coil arrangement having at least one section made of a superconductive strip conductor which is continuously wound in a cylindrical winding chamber between two end flanges in multiple, solenoid-like layers. The known arrangement is characterized in that the section has an axial region of reduced current density (a notch region). However, the number of windings at the coil edges compared to the interior of this axial region is not reduced. As a result, no reduction of the radial field is achieved.

Another coil geometry (e.g., described in JP H06-5 414 A) shows the inner diameter of the windings on the coil edge expanding in order to reduce the influence of the vertical field components on the critical current density. In this arrangement, among other things, the inner coil radius is varied axially, which for various reasons is not particularly advantageous and is diametrically opposed to the corresponding feature of a coil in the class. In addition, the co-winding of non-superconducting material in a layer wound coil with cylindrical symmetry about the axis of symmetry z is not disclosed.

Another prior art coil geometry (e.g., CHEN, X. Y., JIN, J. X.: Evaluation of Step-Shaped Solenoidal Coils for Current-Enhanced SMES Applications. IEEE Transactions an Applied Superconductivity, Vol. 24, 2014, No. 5, S. 1-4. IEEE Xplore [online]. D01: 10.1109/TASC.2014.2356572) describes a superconductive magnet coil arrangement in the class, having the some of the features described herein. However, the coil described in the prior art is formed exclusively from pancake coils, and not layer wound coils with cylindrical symmetry about the axis of symmetry, and no co-winding of non-superconducting material is disclosed.

SUMMARY

In the following, we consider a cylindrically-symmetrical magnet coil of layer wound anisotropic superconductor material, wherein the current-carrying capacity thereof is more greatly suppressed by the radial field component generated by the coil than by the axial field component. The term 'layer wound' means that subsequent windings along the superconductor are substantially wound adjacently in layers along the axis of symmetry, and a constant radius can be assigned to each layer. This is in contrast to so-called pancake coils, in which subsequent windings are primarily wound radially one above the other.

The invention relates to a superconductive magnet coil arrangement comprising a hollow coil with a constant inner radius to generate an operating magnetic field in a working volume about an axis of symmetry. The coil has windings made of an anisotropic superconductor, The superconducting current-carrying capacity of the anisotropic superconductor in a magnetic field perpendicular to the current direction in the windings depends on both the field amplitude and the field direction in a plane perpendicular to the current direction. The hollow coil has a sectional plane which includes the axis of symmetry and the coil has a rectangular coil cross-section in the sectional plane. The rectangular coil cross-section is defined by a radially inner edge, a radially outer edge, a first axial edge, and second axial edge. The radially inner edge is defined by the position of a radially innermost winding of the hollow coil closest to the axis of symmetry. The radially outer edge is defined by a radially outermost winding of the coil furthest from the axis of symmetry. The first axial edge is defined by the position of an axially first winding of the hollow coil with the smallest coordinate along the axis of symmetry. The second axial edge is defined by the axially last winding of the coil with greatest coordinate along the direction of the axis of symmetry.

The coil has a first radially-bounded rectangular coil region which fully overlaps the coil cross-section along the direction of the axis of symmetry and contains no layer which is fully wound in the axial direction. The coil also includes a second radially-bounded rectangular coil region inside the first coil region. The second coil region fully overlaps the first coil region radially and overlaps 10% of the first coil region along the direction of the axis of symmetry. The second coil region also includes the first or second axial coil edge. The coil includes a third radially-bounded rectangular coil region inside the first coil region. The third coil region fully overlaps the first coil region radially and overlaps 40% of the first coil region along the direction of the axis of symmetry, and also adjoins the second coil region. The number of windings of the anisotropic superconductor in the third coil region is more than four and one-half times the number of windings of the anisotropic superconductor in the second coil region. The coil further includes a fourth and a fifth radially-bounded rectangular coil region inside the coil cross-section. The fourth and fifth coil regions fully overlap the coil cross-section radially and each overlap 10% of the coil cross-section along the direction of the axis of symmetry including the first and/or second axial coil edges, respectively. The fourth and fifth coil regions have a first and a second number of coil edge windings determined by the number of windings of the anisotropic superconductor in the fourth and/or the fifth coil regions, respectively. The maximum number of coil edge windings is determined by the quotients of the cross-sectional area of the fourth or fifth coil regions, respectively, and the cross-sectional area of the anisotropic superconductor.

The techniques presented herein modify a superconductive magnet coil arrangement of the type defined above with particularly simple technical means in such a manner that the limitations discussed above for such superconductive magnet coil arrangements, which typically arise at the axial ends of the coil, are significantly attenuated, and the current-carrying capacity off the coil is significantly increased. A method for the design of the coil arrangement is also presented.

The magnet coil described herein is layer wound with cylindrical symmetry about the axis of symmetry. The coil is laid out in such a manner that the resulting magnetic field has a field component $B_r$ perpendicular to the current direction and the axis of symmetry. The field component $B_r$ has a maximum in the coil volume which is at least 5% lower than if—given the same operating field of a comparable coil in the center of the working volume—the lengths of the fourth and fifth coil regions were shortened along the direction of the axis of symmetry toward the center of the comparable coil. The relative shortening of the lengths corresponds to the ratio of the first number of coil edge windings to the maximum number of coil edge windings in the fourth coil region, as well as the ratio of the second number of coil edge windings to the maximum number of coil edge windings in the fifth coil region. The number of windings of the anisotropic superconductor in the comparable coil remains the same. Additionally, the minimum of the superconducting current-carrying capacity of the anisotropic superconductor in the coil is at least 3% higher than if—given the same operating field of the comparable coil in the center of the working volume—the lengths of the fourth and fifth coil regions were shortened along the direction of the axis of symmetry toward the center of the comparable coil. The relative shortening of the lengths corresponds to the ratio of the first number of coil edge windings to the maximum number of coil edge windings in the fourth coil region, as well as to the ratio of the second number of coil edge windings to the maximum number of coil edge windings in the fifth coil region. The number of windings of the anisotropic superconductor in the coil remains the same comparable coil, and in that, in the first coil region, non-superconducting material is also wound together with the superconducting material toward the edge along the edge axis of symmetry.

BRIEF DESCRIPTION OF THE DRAWINGS

The invention is illustrated in the drawings and will be described in greater detail with examples of embodiments, wherein.

DETAILED DESCRIPTION

Figure 1:
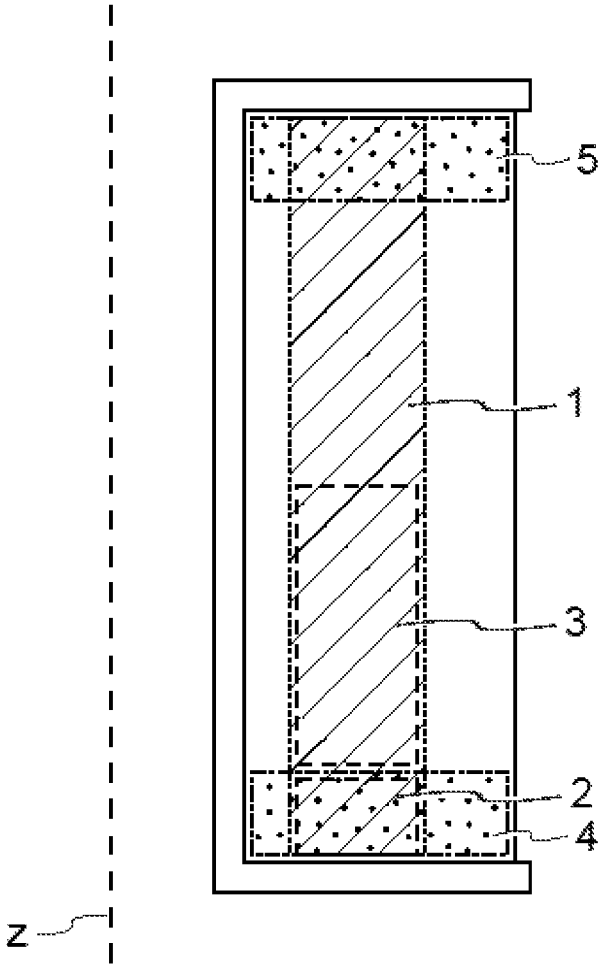
FIG. 1 shows a schematic sectional view of a first example of the magnet coil arrangement, cutaway in a plane which contains the axis of symmetry z, with the relative geometric arrangement of the five defined coil regions in a first example (due to the symmetry, only one half of the coil is illustrated)

In certain circumstances, the current-carrying capacity of coils which are wound from an anisotropic superconductor is limited on the axial ends by the radial magnetic field component. The techniques described herein provide for a superconductive magnet coil arrangement that makes it possible to attenuate this field component and increase the current-carrying capacity of the coil.

The current-carrying capacity of the superconductor at the axial coil ends is increased by attenuating the radial component of the magnetic field. This is achieved according to the techniques presented herein by reducing the number of windings in regions on the coil ends, while keeping both the cross-section and the type of superconductor the same.

The lower number of windings near to the axial coil ends leads to a distribution of the radial magnetic flux over a greater axial region, and to the radial component of the magnetic field being locally smaller. As a result, the current-carrying capacity of the superconductor, and therefore of the entire coil, is accordingly increased.

One advantage of this arrangement is the smoother distribution of the current-carrying capacity of the superconductor in the coil as a whole. As a result, the superconductor is better exploited for the current flow and the coil can be operated at a higher current. The required amount of superconductor material, and therefore the production costs, are consequently less than in comparable conventional arrangements. Alternatively, it is possible to generate a greater magnetic field in the center of the coil using the same amount of superconductor.

In contrast to arrangements in which the radial field is influenced passively (e.g., with ferromagnetic elements) the arrangement according to the techniques presented herein is significantly more efficient due to the conscious selection of the distribution of windings in the coil. Moreover, no additional winding body is required to implement the arrangement, thereby saving space and material costs.

A particular advantage over the prior art is the possibility of using a single type of superconductor in the entire coil. If different superconductors are necessary (e.g., made of different superconducting material or having different geometries) they must necessarily be connected so that the electrical current can flow through the conductor pieces in series. The connection of different superconductors can be very technically challenging and time-consuming.

The non-superconducting material wound together with the superconducting material toward the edges of the coil serves the purpose of filler and contributes to the mechanical stability of the winding pack.

In a first example of the magnet coil arrangement, the sum of the number of windings taken radially is reduced toward the edge along the axis of symmetry z in one or more discrete steps in the fourth and/or in the fifth coil region. As a result, it is possible to significantly decrease the radial field component in the coil ends and significantly increase the current-carrying capacity.

In another example, the sum of the number of windings taken radially is reduced toward the edge along the axis of symmetry z quasi-continuously in the fourth and/or in the fifth coil region. This enables an even finer modulation of the radial field component along the axial coil ends, as well as an improved optimization of the current-carrying capacity.

In some examples of the magnet coil, the windings in the first radially-bounded rectangular coil region are wound from a single, continuous superconductor piece. In other words, the superconductor coils are formed without joints which link together different conductor pieces. The electrical resistance in the coil is consequently kept very low. Joints between HTS superconductors typically have a certain electrical resistance and lead to a drift in the magnetic field if the coil is not supplied by a current source. Joints which are situated in the winding package of the coil may also worsen the field homogeneity in the working volume. Additionally, the winding of a single conductor piece has technical advantages in the manufacturing process.

Additional examples of the magnet coil arrangement according to the techniques presented herein are characterized in that the second coil region is wound with at least 20%, particularly with 40% to 60%, and preferably with approximately 50% fewer conductor windings than an axially adjoining coil region of the same geometry. The radial field component on the axial coil ends is particularly sharply reduced, and the current-carrying capacity of the coil is significantly increased, by a reduction in the number of windings in this range of values.

In one class of examples of the coil arrangement, the magnetic field generated by the coil has a field component $B_r$ perpendicular to the current direction and to the axis of symmetry z. The field component $B_r$ has a maximum in the coil volume which is at least 10%, and preferably up to 50% lower than if—given the same operating field of the coil in the center of the working volume—the lengths of the fourth and fifth coil regions were shortened along the direction of the axis of symmetry toward the center of the coil. The relative shortening of the lengths corresponds to the ratio of the first and second numbers of coil edge windings to the maximum number of coil edge windings with the number of windings of the anisotropic superconductor in the coil remaining the same. When the radial component $B_r$ is reduced this sharply, the increase in the current-carrying capacity of the coil is particularly notable.

Additional examples of the magnet coil are characterized in that the minimum of the superconducting current-carrying capacity of the anisotropic superconductor in the coil is at least 5%, and particularly up to 30%, and preferably up to 50% higher than if—given the same operating field of the coil in the center of the working volume—the lengths of the fourth and fifth coil regions were shortened along the axis of symmetry toward the center of the coil. The relative shortening of the lengths corresponds to the ratio of the first and second numbers of coil edge windings to the maximum number of coil edge windings with the number of windings of the anisotropic superconductor in the coil remaining the same. With a greater current-carrying capacity of the coil, either a greater magnetic fields can be generated, or a smaller amount of superconductor material is required to generate a given field strength in the working volume.

Some examples of the magnet coil are characterized in that the co-wound non-superconducting material has foil inserts. Foils may be particularly well accommodated between the superconducting windings, and can be easily cut to the desired geometry.

In another example, the reduction in the number of windings at the axial coil ends is achieved by not forming as many windings at the coil edges. In other words, a void with no windings is formed over multiple directly superimposed layers at the coil edges.

The techniques presented herein also include a method for laying out a superconductive magnet coil arrangement as described herein. In particular, a coil is wound from an anisotropic superconductor with cylindrical symmetry about an axis of symmetry. In the first coil region, non-superconducting material is also wound together with the superconducting material toward the edge. The current carrying capacity of the coil, initially limited on the axial ends by the radial magnetic field component, is optimized by reducing the number of windings in the axial end regions (i.e., optimization regions) in such a manner that its superconducting current-carrying capacity is increased. The optimization involves reducing the maximum radial magnetic field component by varying the following parameters:

the size of the optimization regions at the axial coil ends in which the number of windings is reduced, the number of windings in the optimization regions, and the distribution of the windings within the optimization regions.

The optimization regions in this case may also protrude beyond the coil ends of the initial coil. In other words, the optimized coil can be markedly longer axially than the initial coil. The exact distribution of windings in the optimization regions can furthermore be selected such that it is advantageous with respect to the forces in the winding package and/or with respect to the technical winding process.

The advantage of this method is that it leads to a coil design which has an increased current-carrying capacity, and that the coil requires a smaller overall amount of superconductor for operation with a given magnetic field strength than the initial coil.

FIG. 1 schematically illustrates a first example of the magnet coil arrangement. In the winding package of the coil, the coil regions 1 to 5 are defined within the rectangular coil cross-section to fulfill the requirements described herein.

The number of windings at the axial ends of the coil is reduced with respect to the axially inner regions. As a result, at least one winding layer is not entirely wound with the superconductor. A first radially-bounded rectangular coil region 1 is defined which partially overlaps the coil cross-section radially and fully overlaps the coil cross-section along the direction of the axis of symmetry z, and contains no fully-wound layer. The first coil region 1 includes two sub-regions which characterize the reduction of the number of windings at one axial end of the first coil region: a second coil region 2 which overlaps the first coil region 1 along the axis of symmetry over 10% of its length from the coil edge, and a third coil region 3 which adjoins the second coil region 2 and overlaps the first coil region 1 along the axis of symmetry over 40% of its length. In one example, the second and third regions 2, 3 are characterized in that the number of windings in the second coil region 2 is at least four and one-half times less than that in the third coil region 3.

The reduction of the number of windings at the axial coil ends in the magnet coil arrangement leads to a reduction in the maximum radial field component, and consequently to an increase in the current-carrying capacity. To this end, a fourth coil region 4 and a fifth coil region 5 are defined which completely overlap the coil cross-section radially and each overlap 10% of the coil cross-section axially from one of the two coil edges along the axis of symmetry z. In a comparative arrangement, the fourth and the fifth coil regions 4, 5 are shortened toward the center of the coil along the direction of the axis of symmetry such that there would be no space for further windings if the amount of superconductor remains the same. The arrangement according to the techniques presented herein provides for a i maximum radial field component at least 5% smaller, and a current-carrying capacity at least 3% greater, than in the comparative arrangement.

In one example, a coil arrangement is described and compared to a conventional coil with the following properties:

Geometry of the anisotropic superconductor: 2 mm×0.2 mm (cross-section)

Radius of the radially-inner coil edge: 20 mm

Radius of the radially-outer coil edge: 36 mm

Coil length in the axial direction: 192 mm (96 windings per layer)

Number of wound layers: 80; all layers are fully-wound.

The coil arrangement according to the techniques presented herein is wound from the same superconductor and characterized by the following properties:

Radius of the radially-inner/outer coil edge: 20 mm/32.8 mm

Coil length: 240 mm 64 layers alternating fully wound (120 windings) and not fully-wound (e.g. according to the schematic illustration in FIG. 2A), wherein each non-fully-wound layer is constructed along the axis of symmetry, beginning at one coil edge, as follows: 48 mm without windings, 144 mm with 72 windings, 48 mm without windings.

To test the properties of the coil arrangement according to the invention, any non-fully-wound layer (e.g. the radially most-inward layer shown in FIG. 2A) can be defined as the first coil region. The third coil region 3 contained therein then includes 84, and as such 7-times (that is, more than four and one-half times) as many windings as the second coil region 2, with 12 windings. Furthermore, the comparative coil is obtained after shortening the fourth and/or fifth coil region 4, 5 according to the description of the invention, as listed in the following table:

| | Conventional | Inventive | Comparison |
|---|---|---|---|
| Magnetic field | 4.7 T | 4.7 T | 4.7 T |
| Operating current | 97.4 A | 122.0 A | 121.9 A |
| Superconductor length | 1351 m | 1019 m | 1019 m |
| Maximum radial field | 1.8 T | 1.0 T | 1.7 T |
| Current carrying capacity | 100.5 A | 125.2 A | 107.9 A |
| Current load | 97% | 97% | 113% |

The maximum radial field of the coil arrangement is smaller than that of the comparative coil by about 40%. The current-carrying capacity is accordingly increased by 16%.

Compared to the conventional coil, the inventive coil according to the techniques presented herein as calculated in the example can be operated at a higher current due to the increased current-carrying capacity. To generate the same field in the working volume (e.g., 4.7 T), at the same current load (i.e., the ratio of the operating current to the current-carrying capacity), the amount of superconductor needed for the winding drops by 25%.

Figure 2A:
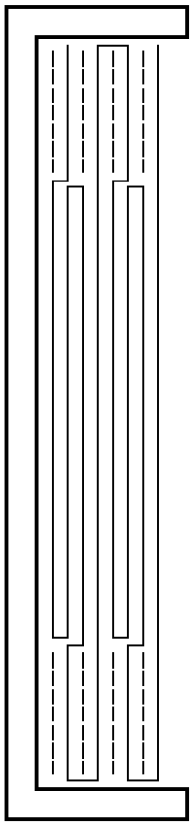
FIGS. 2A-D show schematic sectional views of further examples of the magnet coil arrangement; wherein FIG. 2A, and FIG. 2C each show the winding arrangement, and FIG. 2B and FIG. 2D each show the associated coil regions of a second and/or third example embodiment.
Figure 2B:
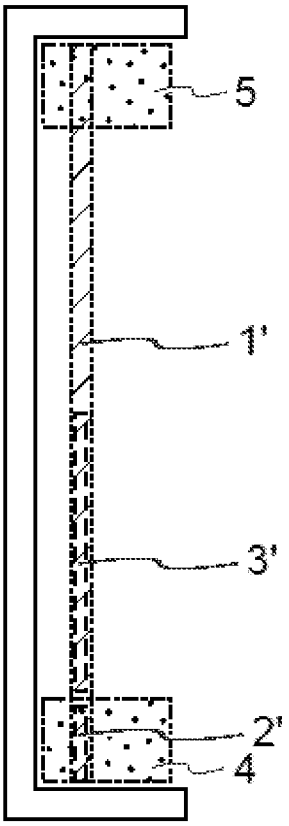
Figure 2C:
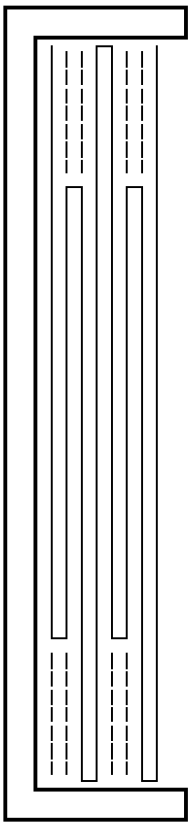
Figure 2D:
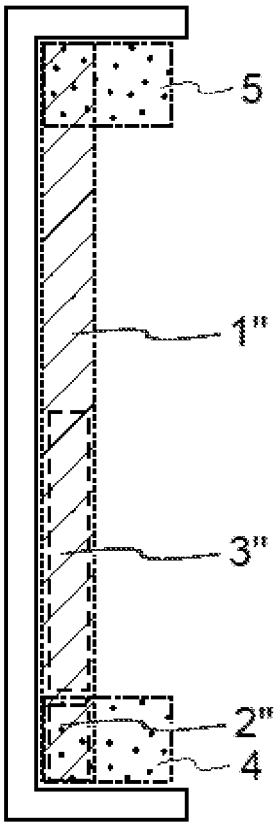

FIGS. 2A to 2D show examples in which all of the windings in the first coil region are made with a single, uninterrupted superconductor piece. The solid lines in the winding package in FIGS. 2A and 2C schematically represent the superconductor, and the dashed lines represent the non-superconducting fill material. FIGS. 2B and 2D illustrate the coil regions 1'/1", 2'/2", 3'/3", and 4 and 5, corresponding to FIGS. 2A and 2C, respectively.

The coil region 1' (FIG. 2B) contains, for example, the incompletely wound layer which is the third innermost layer radially. The coil region 1" (FIG. 2D) contains, for example, the three, radially innermost, incompletely wound layers.

Figure 3A:
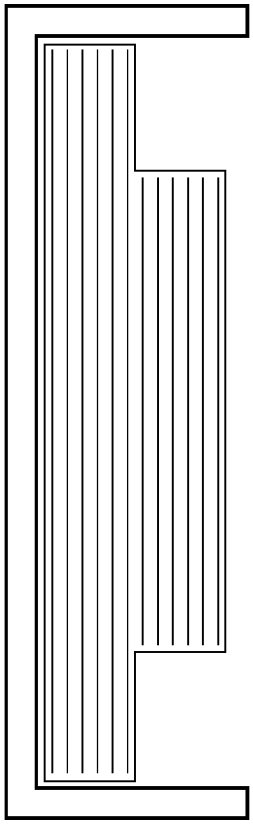
FIGS. 3A, B show schematically a winding arrangement (FIG. 3A) and the associated coil regions (FIG. 3B) of a fourth example embodiment.
Figure 3B:
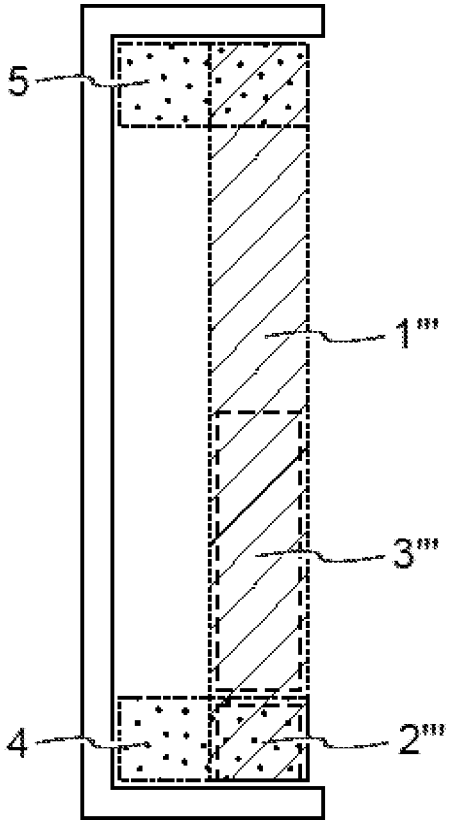

FIGS. 3A and 3B show an example in which the reduction in the number of windings at the axial coil ends is achieved by making a void of windings at the coil edges over multiple directly superimposed layers. The continuous lines in the winding package in FIG. 3A schematically represent the layer regions which are wound from superconductor. FIG. 3B illustrates the coil regions 1''', 2''', 3''', and 4 and 5, corresponding to FIG. 3A.

It must be noted that the axial boundaries of the coil regions 2 to 5 need not necessarily correspond to the boundaries between fully wound and non-fully wound regions in the coil.

Figure 4A:
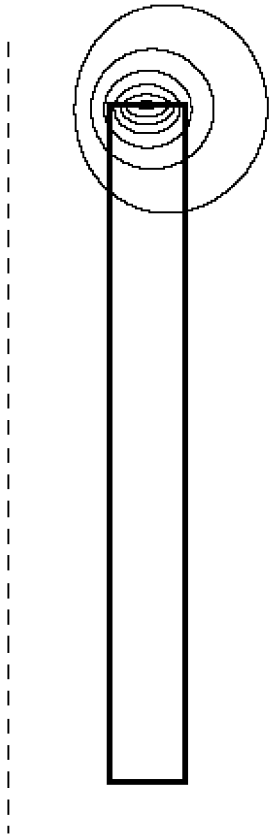
FIGS. 4A, B show schematically a comparison of the radial fields at the edge of a conventional magnet coil arrangement (FIG. 4A) and a magnet coil arrangement modified according to an example embodiment (FIG. 4B)
Figure 4B:
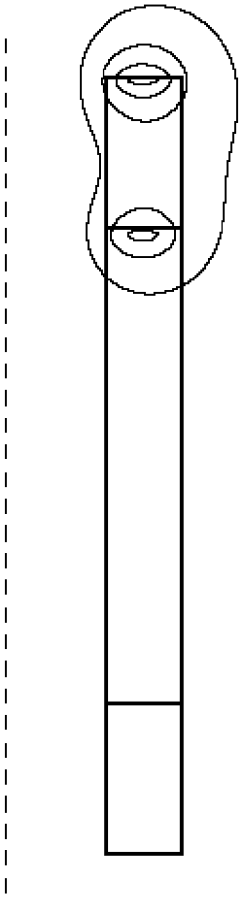

FIGS. 4A and 4B show, in a side-by-side comparison, the radial fields at the edge of a conventional magnet coil arrangement and a magnet coil arrangement modified according to the techniques presented herein. In each case, cylindrically symmetrical magnet coils (depicted with a cross-section through a plane containing the axis of symmetry z) are illustrated, along with the contour field lines of the radial component of the magnetic field. The outermost lines correspond to 0.25 T; the field strengthens by 0.25 T with each line closer to the maximum.

In the arrangement modified according to the techniques presented herein, shown in FIG. 4B, the number of windings on the axial ends is reduced. In the conventional arrangement according to the prior art, shown in FIG. 4A, a reference coil with a homogeneous number of windings is illustrated which has the same inner and outer radius as the arrangement according to the invention, and the coil length along the axis of symmetry is selected such that the same amount of conductor is wound as in the coil according to the techniques presented herein. In the conventional magnet coil arrangement, the maximum radial field achieves a strength of approximately 1.75 T, while in the arrangement according to the invention, at the same magnetic field strength in the center of the working volume, it is only approximately 1.0 T.

At the same current load, but higher current, the coil according to the techniques presented herein generates a greater magnetic field in its center than the conventional reference coil because its current-carrying capacity is greater than that of the reference coil.

Figure 5A:
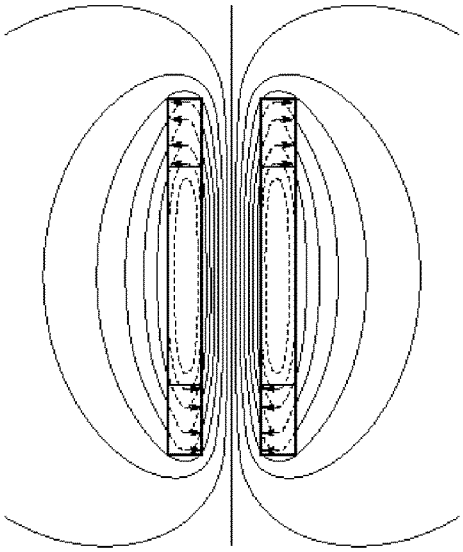
FIGS. 5A, B show schematically a comparison of the magnetic field line profiles of a magnet coil arrangement according to an example embodiment (FIG. 5A) and a magnet coil arrangement according to the prior art (FIG. 5B).
Figure 5B:
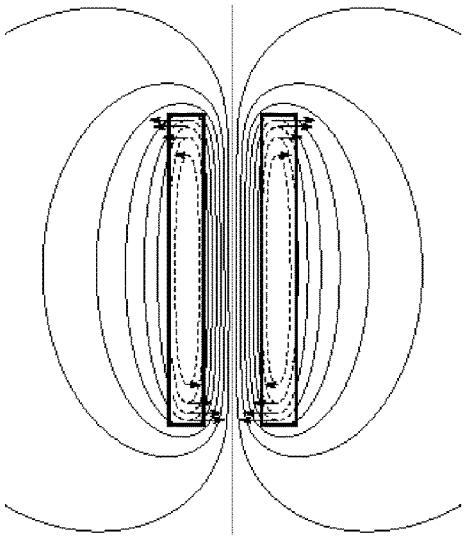

FIGS. 5A and 5B illustrate the field lines of the magnetic field generated in a cylindrically symmetrical magnet coil arrangement according to the techniques presented herein (FIG. 5A) and in an arrangement according to the prior art (FIG. 5B), respectively, in a schematic sectional view through a plane which contains the axis of symmetry z.

In the arrangement shown in FIG. 5A, the number of windings of the superconductor on the axial edge regions is reduced compared to the central region. The field lines represent the magnetic flux, and their density corresponds to the strength of the magnetic field. Because of the reduction in the number of windings, the magnetic flux flowing around the coil ends is distributed over axially longer regions, and is significantly diluted. The magnetic field strength accordingly has a relatively small component in the radial direction (as shown by the arrows in FIG. 5A).

FIG. 5B shows a cylindrically symmetrical coil with homogeneous (full) current density, according to the prior art, with a constant number of windings along the axis of symmetry. Compared to the arrangement shown in FIG. 5B, the axial ends are shortened toward the center of the coil such that the total number of windings of the coil is constant. Also, the prior art coil generates the same field strength in the center as the coil according to the techniques presented herein. However, because of the abruptly vanishing number of windings, the magnetic flux is concentrated at the axial coil edges. The flux concentration leads to a greater radial magnetic field component with a maximum at these locations (as shown by the arrows in FIG. 5B).

In comparison, FIG. 5A shows a coil according to the techniques presented herein, wherein the current density at the axial ends has been reduced. The magnetic field strength, which corresponds to the density of the field lines, is significantly reduced at the ends of the coil shown in FIG. 5A A substantial advantage of the arrangement according to the techniques presented herein is found, among other things, in the smoother distribution of the current-carrying capacity of the superconductor in the coil as a whole. As a result, the superconductor is better exploited, and the coil can be operated at a higher current. The amount of superconductor needed, and therefore the material cost, is reduced, or, alternatively, it is possible to generate a greater magnetic field in the center of the coil using the same amount of superconductor.

Another advantage over the prior art is the possibility of using a single type of superconductor in the entire coil.

LIST OF REFERENCE NUMBERS

1; 1'; 1"; 1''' first radially-bounded rectangular coil region
2; 2'; 2"; 2''' second radially-bounded rectangular coil region
3; 3'; 3"; 3''' third radially-bounded rectangular coil region
4 fourth rectangular coil region
5 fifth rectangular coil region
z axis of symmetry of the magnet coil arrangement

What is claimed is:

1. A coil arrangement comprising:

a hollow coil with a constant inner radius about an axis of symmetry to generate a magnetic field in a working volume, wherein the hollow coil has windings of an anisotropic superconductor with a superconducting current-carrying capacity in a magnetic field perpendicular to a current direction in the anisotropic superconductor depending on both a magnetic field amplitude and a magnetic field direction in a plane perpendicular to the current direction; and a sectional plane which includes the axis of symmetry and which intersects the hollow coil, wherein the hollow coil has a rectangular coil cross-section in the sectional plane that is defined by a radially inner edge, a radially outer edge, a first axial edge, and a second axial edge, the radially inner edge defined by a radially innermost winding of the hollow coil, the radially outer edge defined by a radially outermost winding of the hollow coil, the first axial edge defined by an axially first winding of the hollow coil with a smallest coordinate along a direction of the axis of symmetry, and the second axial edge defined by an axially last winding of the hollow coil with a greatest coordinate along the direction of the axis of symmetry, wherein the hollow coil includes:

a first coil region that fully overlaps the rectangular coil cross-section along the direction of the axis of symmetry and contains no layer which is fully wound in the axial direction, wherein the layer is a region limited in the axial direction by a length of the hollow coil and in a radial direction by a constant radius;

a second coil region within the first coil region, the second coil region fully overlapping the first coil region radially and overlapping 10% of the first coil region along the direction of the axis of symmetry and including the first axial edge or second axial edge;

a third coil region inside the first coil region, the third coil region fully overlapping the first coil region radially and overlapping 40% of the first coil region along the direction of the axis of symmetry and abutting the second coil region, wherein a number of windings of the anisotropic superconductor in the third coil region is at least four and one-half times a number of windings of the anisotropic superconductor in the second coil region;

a fourth coil region inside the rectangular coil cross-section, the fourth coil region fully overlapping the rectangular coil cross-section radially, overlapping 10% of the rectangular coil cross-section along the direction of the axis of symmetry, and including the first axial edge, wherein a first number of coil edge windings is determined by a number of windings of the anisotropic superconductor in the fourth coil region; and a fifth coil region inside the rectangular coil cross-section, the fifth coil region fully overlapping the rectangular coil cross-section radially and overlapping 10% of the rectangular coil cross-section along the direction of the axis of symmetry, and including the second axial edge, wherein a second number of coil edge windings is determined by the number of windings of the anisotropic superconductor in the fifth coil region;

wherein a maximum number of coil edge windings is determined by a quotient of a cross-sectional area of the fourth coil region or a cross-sectional area of the fifth coil region and a cross-sectional area of the anisotropic superconductor, wherein the windings of the anisotropic superconductor are layer wound with cylindrical symmetry about the axis of symmetry, wherein the windings of the anisotropic superconductor are laid out in such a manner that the generated magnetic field has a field component $B_r$ perpendicular to the current direction and to the axis of symmetry, the maximum of the field component $B_r$ in the windings of the anisotropic superconductor being at least 5% lower than a comparable field component $B_r$ generated by a comparable coil that generates the same magnetic field in the center of the working volume with lengths of the fourth coil region and fifth coil region shortened along the axis of symmetry toward a center of the comparable coil, wherein the lengths of the fourth coil region and the fifth coil region are shortened by a ratio of the first number of coil edge windings to the maximum number of coil edge windings in the fourth coil region, as well as a ratio of the second number of coil edge windings to the maximum number of coil edge windings in the fifth coil region, with the number of windings of the anisotropic superconductor in the comparable coil remaining the same as the number of windings of the anisotropic superconductor in the hollow coil, wherein a minimum of the superconducting current-carrying capacity of the anisotropic superconductor in the hollow coil is at least 3% higher than a superconducting current-carrying capacity of the anisotropic superconductor in the comparable coil, and wherein non-superconducting material is wound together with the anisotropic superconductor in the first coil region toward the first axial edge and the second axial edge along the axis of symmetry.

2. The coil arrangement according to claim 1, wherein the second coil region is wound with at least 20% fewer conductor windings than an axially adjoining coil region of the same geometry.

3. The coil arrangement according to claim 2, wherein the second coil region is wound with 40% to 60% fewer conductor windings than the axially adjoining coil region of the same geometry.

4. The coil arrangement according to claim 3, wherein the second coil region is wound with 50% fewer conductor windings than the axially adjoining coil region of the same geometry.

5. The coil arrangement according to claim 1, wherein the maximum of the field component $B_r$ in the windings of the anisotropic superconductor is at least 10% lower than a field component $B_r$ in the comparable coil.

6. The coil arrangement according to claim 5, wherein the maximum of the field component $B_r$ in the windings of the anisotropic superconductor is up to 50% lower than a field component $B_r$ in the comparable coil.

7. The coil arrangement according to claim 1, wherein the minimum of the superconducting current-carrying capacity of the anisotropic superconductor is at least 5% higher than a minimum of the superconducting current-carrying capacity of the anisotropic superconductor in the comparable coil.

8. The coil arrangement according to claim 7, wherein the minimum of the superconducting current-carrying capacity of the anisotropic superconductor is at least 30% higher than a minimum of the superconducting current-carrying capacity of the anisotropic superconductor in the comparable coil.

9. The coil arrangement according to claim 8, wherein the minimum of the superconducting current-carrying capacity of the anisotropic superconductor is up to 50% higher than a minimum of the superconducting current-carrying capacity of the anisotropic superconductor in the comparable coil.

10. The coil arrangement according to claim 1, wherein the number of windings of the anisotropic superconductor in the fourth coil region or the number of windings of the anisotropic superconductor in the fifth coil region decreases toward the first axial edge or the second axial edge, respectively, in discrete steps along the axis of symmetry.

11. The coil arrangement according to claim 1, wherein the number of windings of the anisotropic superconductor in the fourth coil region or the number of windings of the anisotropic superconductor in the fifth coil region decreases toward the first axial edge or the second axial edge quasi-continuously along the axis of symmetry (z).

12. The coil arrangement according to claim 1, wherein windings in the first coil region are wound from a single, continuous superconductor piece.

13. The coil arrangement according to claim 1, wherein the non-superconducting material comprises foil inserts.

14. A method for laying out a coil arrangement according to claim 1, comprising:

proceeding from a coil arrangement with a coil of the anisotropic superconductor which is layer wound with cylindrical symmetry about the axis of symmetry, and winding non-superconducting material together with the anisotropic superconductor in the first coil region toward the edge along the axis of symmetry, wherein the superconducting current-carrying capacity of the coil is limited on axial ends by the field component $B_r$ with a maximum radial magnetic field component minimized by reducing a number of windings in optimization regions of the coil comprising the fourth coil region and the fifth coil region, wherein the superconducting current-carrying capacity of the coil is increased by varying at least one parameter selected from:

a size of the optimization regions in which the number of windings is reduced, the number of windings in the optimization regions, and a distribution of windings in the optimization regions.

* * * * *